United States Patent [19]

Tanaka

[11] Patent Number: 4,492,101

[45] Date of Patent: Jan. 8, 1985

[54] LOCK CYLINDER ATTACHING DEVICE FOR VEHICLE MOVABLE CLOSURE LOCKS

[75] Inventor: Yoshiyuki Tanaka, Sagamihara, Japan

[73] Assignee: Nissan Motor Co., Ltd., Yokohama, Japan

[21] Appl. No.: 418,093

[22] Filed: Sep. 14, 1982

[30] Foreign Application Priority Data

Sep. 25, 1981 [JP] Japan ..... 56-151737

[51] Int. Cl.[3] ..... E05B 9/08

[52] U.S. Cl. ..... 70/370; 70/451

[58] Field of Search ..... 70/451, 370, 447; 248/27

[56] References Cited

U.S. PATENT DOCUMENTS

| | | | |
|---|---|---|---|
| 2,506,642 | 5/1950 | Jacobi | 70/370 |
| 2,549,724 | 4/1951 | Tinnerman | 70/370 |
| 3,868,836 | 3/1975 | La Roche | 70/370 |

FOREIGN PATENT DOCUMENTS 2450222 5/1976 Fed. Rep. of Germany .

*Primary Examiner*—Robert L. Wolfe

*Attorney, Agent, or Firm*—Lane, Aitken & Kananen

[57] ABSTRACT

A lock cylinder attaching device is of the type for use in a vehicle movable closure lock and comprises a support for attaching an inner end of a lock cylinder to a vehicle body member in addition to means for attaching the outer end of the lock cylinder to the vehicle body member.

4 Claims, 7 Drawing Figures

LOCK CYLINDER ATTACHING DEVICE FOR VEHICLE MOVABLE CLOSURE LOCKS

BACKGROUND OF THE INVENTION

1. Field of the Invention

The present invention relates in general to vehicle movable closure locks such as vehicle door locks and more particularly to a device for attaching a lock cylinder to a vehicle body member such as a door outer panel.

2. Description of the Prior Art

FIG. 1 shows a typical means for attaching a lock cylinder 10 to a door outer panel 12. The door outer panel 12 is formed with a hole 12*a* to accommodate therein the outer end portion 10*a* of the lock cylinder 10. The lock cylinder 10 has an enlarged head 10*c* at the outward termination of the outer end portion 10*a* thereof and is adapted to be insertable only from the outside of the door outer panel 12. The lock cylinder 10 is fixed to the door outer panel 12 by means of a clip 14 which is fitted in an annular peripheral groove 16 provided to the outer end portion 10*a* of the lock cylinder 10 and cooperates with the enlarged head 10*c* of the lock cylinder 10 to clamp therebetween the door outer panel 12. The lock cylinder 10 is thus supported at the outer end portion 10*a* by the door outer panel 12 and has an inner free end 10*b* projecting inwardly of the vehicle body. A lock cylinder lever 18 is attached to the inner end portion 10*b* of the lock cylinder 10 and adapted to be swingable in response to rotation of a key inserted into the lock cylinder 10. The movement of the lock cylinder lever 18 is transferred through a control rod 20 to an unshown door locking mechanism to control locking and unlocking the door.

With such a lock cylinder attaching means, the lock cylinder 10 may be forcibly swung about the outer end portion 10*a* by using a screw driver or the like, making it possible to move the lock cylinder lever 18 upwardly and downwardly without using a key. Such movement of the lock cylinder lever 18 may possibly effect unlocking of the door. For this reason, the above described lock cylinder attaching means is undesirable from an antitheft point of view.

SUMMARY OF THE INVENTION

In accordance with the present invention, there is provided a novel and improved lock cylinder attaching device which comprises a vehicle body member, a lock cylinder arranged transversely of the vehicle body member to have an inner end portion and an outer end portion, means for attaching the outer end portion of the lock cylinder to the vehicle body member, and a support having one end portion fixed to the vehicle body member and the other end portion supporting the inner end portion of the lock cylinder.

This structure enables the lock cylinder attaching device to be free from the drawback noted above.

It is accordingly an object of the present invention to provide a novel and improved lock cylinder attaching device which is free from the drawback noted above.

It is another object of the present invention to provide a novel and improved lock cylinder attaching device of the above described character which enables a vehicle movable closure lock to obtain a positiveand assured antitheft character.

BRIEF DESCRIPTION OF THE DRAWINGS

The features and advantages of the lock cylinder attaching device according to the present invention will become more clearly appreciated from the following description taken in conjunction with the accompanying drawings, in which like reference characters designate like or corresponding parts throughout the several views and wherein.

DESCRIPTION OF THE PREFERRED EMBODIMENTS

Figure 1:
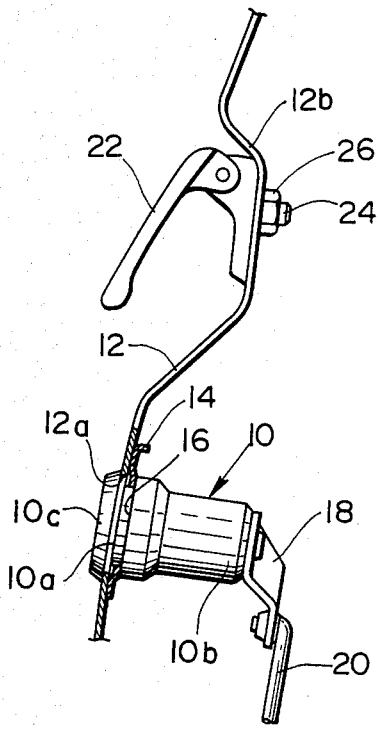
FIG.1 PRIOR ART
FIG. 1 is a sectional view of a prior art door lock cylinder attaching device.
Figure 2:
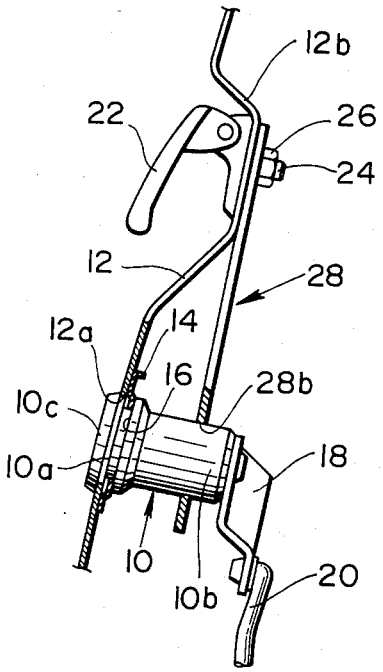
FIG. 2 is a partial sectional view of a door lock cylinder attaching device according to an embodiment of the present invention.
Figure 3:
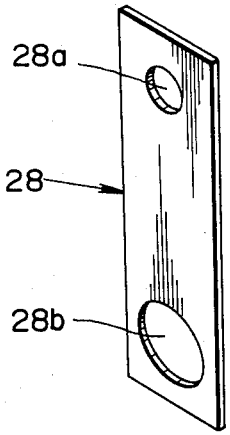
FIG. 3 is a perspective view of a support employed in the lock cylinder attaching device of FIG. 2.

Reference being first made to FIGS. 2 and 3, a lock cylinder attaching device according to an embodiment of the present invention is shown to comprise means for attaching an outer end portion 10*a* of a lock cylinder 10 to a vehicle body member or a vehicle movable closure such as a door outer panel 12 as shown in the drawing. This lock cylinder outer end portion attaching means is substantially similar to that of the prior art device of FIG. 1. The door outer panel 12 is shown to have a recessed or inwardly bulged portion 12*b* for the disposition of an outside door handle 22 which is held in place by means of bolt 24 and nut 26. The bulged portion 12 has a relatively large structural strength as compared with other parts of the door outer panel 12.

In accordance with the present invention, the lock cylinder attaching device further comprises a support 28 in the form of a rectangular, flat plate arranged to be elongated vertically. The support 28 has at the upper end portion thereof a bolt accommodation hole 28*a* accommodating therein the bolt 24 and at the lower end portion thereof a lock cylinder inner end portion accommodation hole 28 accommodating therein the inner end portion 10*b* of the lock cylinder 10. With these circular holes 28*a* and 28*b*, the support 28 is fixed at the upper end portion thereof to the inwardly bulged portion 12*b* together with the outside door handle 22 by means of the bolt 124 and nut 26 and carries at the lower end portion thereof the inner end portion 10*b* of the lock cylinder 10 by receiving same in the hole 28*b*.

With the provision of the support 28, the lock cylinder 10 is now supported at two axially spaced points thereof, i.e., at both of the outer and inner end portions 10*a* and 10*b* on the door outer panel 12, positively and assuredly preventing the lock cylinder 10 from being swung about the outer end portion 10*a* and thereby enabling the door lock to effect a positive and assured burglarproof action.

Figure 4:
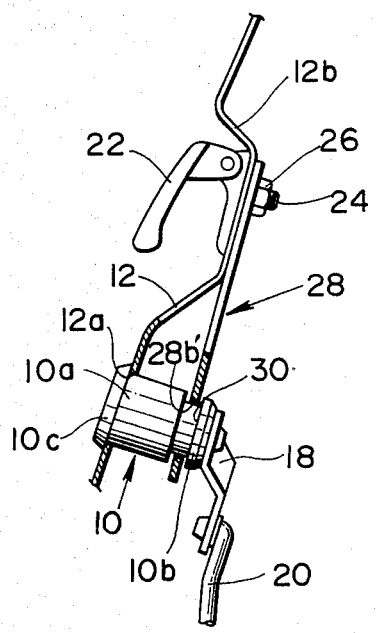
FIG. 4 is a view similar to FIG. 2 but shows a modified embodiment of the present invention.
Figure 5:
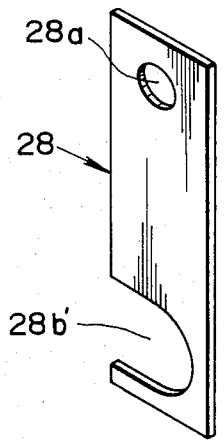
FIG. 5 is a view similar to FIG. 3 but shows a modified support employed in the embodiment of FIG. 4.

Referring to FIGS. 4 and 5, there is shown a modified embodiment of the present invention which is substantially similar to the previous embodiment except for a U-shaped notch or cut 28*b*' formed in the support 28 in place of the circular hole 28*b* and an annular peripheral groove 30 formed in the lock cylinder 10 in place of the groove 16. More specifically, the notch 28*b'* is provided to the lower end portion of the support 28 in a manner to open at one lateral side of same. The annular peripheral groove 30 is provided to the inner end portion 10*b* of the lock cylinder 10 so that the grooved inner end portion 10*b* engagedly fits in the notch 28*b'* of the support 28. With the notch 28*b'* and groove 30, the inner end portion 10*b* of the lock cylinder 10 and the lower end portion of the support 28 are interlocked to prevent the lock cylinder 10 not only from being swung about the outer end portion 10*a* thereof but also from being moved axially thereof relative to the door outer panel 12. The clip 14 employed in the previous embodiment thus can be dispensed with, making it possible to reduce the number of constituent parts of the lock cylinder attaching device. The lock cylinder outer end portion attaching means in case of this embodiment is constituted by the lock cylinder outer end portion accommodation hole 12*a* formed in the door outer panel 12 and the lock cylinder enlarged head 10*c*.

Figure 6:
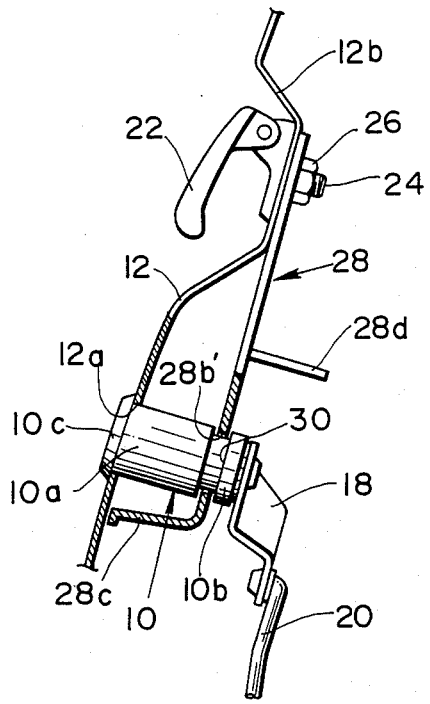
FIG. 6 is a view similar to FIG. 2 but shows another modified embodiment of the present invention.
Figure 7:
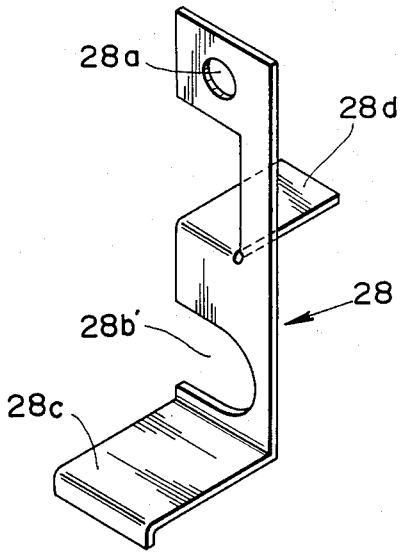
FIG. 7 is a perspective view of another modified support employed in the embodiment of FIG. 6.

Referring to FIGS. 6 and 7, there is shown another modified embodiment of the present invention which is substantially similar to the embodiment of FIGS. 4 and 5 except for a lower end bent portion 28*c* and an intermediate bent portion 28*d* which are both additionally provided to the support 28. The lower bent portion 28*c* projects outwardly from the lower end portion of the support 28 to form an abutment arm which is abuttingly engageable with the door outer panel 12. The lower bent portion 28*c* thus serves as a reinforcement member, increasing the structural strength of the lock cylinder attaching device and thereby providing the door lock with an improved antitheft character. The intermediate bent portion 28*d* projects inwardly from a location intermediate between the upper and lower ends of the support 28 to form a cover which is operative to conceal the inner end portion 10*b* of the lock cylinder 10. Such a cover is quite useful from an antitheft point of view. As seen from FIG. 7, the support 28 is of a single piece and preferably formed from a sheet of metal, and the intermediate portion 28*d* is formed by combined cutting and bending.

Obviously, many variations and modifications of the present invention are possible in light of the above teachings. It is, therefore to be understood that within the scope of the appended claims, the invention may be practiced otherwise than as specifically described.

What is claimed is:

1. A lock cylinder attaching device comprising:

a vehicle body member;

a lock cylinder arranged transversely of said vehicle body member to have an outer end portion and an inner end portion;

means for attaching said outer end portion of said lock cylinder to said vehicle body member; and a support having one end portion fixed to said vehicle body member and the other end portion supporting said inner end portion of said lock cylinder, said support being in the form of an elongated plate having a lower end bent portion and an intermediate bent portion, said lower end bent portion projecting outwardly from the lower end of said support to form an abutment arm which is abuttingly engageable with said door outer panel, said intermediate bent portion projecting inwardly from a location intermediate between the upper and lower ends of said support to form a cover concealing said inner end portion of said lock cylinder.

2. A lock cylinder attaching device as set forth in claim 1, wherein said lock cylinder outer end portion attaching means comprises a hole formed in said vehicle body member to accommodate therein said outer end portion of said lock cylinder and an enlarged head provided to said lock cylinder at the outward termination of said outer end portion.

3. A lock cylinder attaching device as set forth in claim 2, wherein said lock cylinder has at said inner end portion an annular peripheral groove, and wherein said support is formed at said other end portion with a notch in which said grooved inner end portion of said lock cylinder is fitted.

4. A lock cylinder attaching device as set forth in claim 3, wherein said vehicle body member is a door outer panel having an inwardly bulged portion forming a recess in which an outside door handle is disposed, and wherein said one end portion of said support is fixed to said inwardly bulged portion together with said outside door handle.

* * * * *